US005666603A

United States Patent [19]

Kato et al.

[11] Patent Number: 5,666,603

[45] Date of Patent: Sep. 9, 1997

[54] IMAGE-FORMING APPARATUS USING X-RAY FOR CHARGING AND CLEANING A PHOTOSENSITIVE MEMBER

[75] Inventors: Masayoshi Kato; Yasuhiro Tomita; Masayoshi Ishikawa, all of Hamamatsu, Japan

[73] Assignee: Hamamatsu Photonics K.K., Hamamatsu, Japan

[21] Appl. No.: 592,713

[22] Filed: Jan. 26, 1996

[30] Foreign Application Priority Data

Jan. 26, 1995 [JP] Japan ..... 7-011015

[51] Int. Cl.[6] ..... G03G 15/02

[52] U.S. Cl. ..... 399/168; 250/370.09; 361/213; 361/229; 399/343; 399/349

[58] Field of Search ..... 355/219, 296; 361/213, 225, 229; 250/370.09, 324, 325, 326; 430/902

[56] References Cited

U.S. PATENT DOCUMENTS 3,649,116 3/1972 Hall ..... 355/219
3,975,626 8/1976 Engeland et al. ..... 355/219 X

FOREIGN PATENT DOCUMENTS 3-212658 9/1991 Japan .

OTHER PUBLICATIONS

Funtai No Taidenkikou To Seigyo Ouyou, Published by Gijutsu Jyouhou Kikou (Jul. 15, 1990), pp. 124–143.

*Primary Examiner*—Arthur T. Grimley
*Assistant Examiner*—Sophia S. Chen
*Attorney, Agent, or Firm*—Cushman Darby & Cushman, IP Group of Pillsbury Madison & Sutro, LLP

[57] ABSTRACT

An image-forming apparatus which does not adversely affect its surrounding environment when in use, which has excellent durability, and which is safe to use is provided. A photosensitive layer is disposed on the outer surface of a rotatable closed-loop substrate drum. A charger, an exposure portion, a developing portion, a transfer portion, a fixing portion, and a cleaner are provided around the substrate drum. The charger includes an X-ray generator, which electrolytically dissociates the air on the surface of the photosensitive layer upon X-ray irradiation, and electric-field generator which guides a gaseous ion formed by electrolytic dissociation to the surface of the photosensitive layer. The cleaner is constituted by erasure X-ray generation means which ionizes the air on the photosensitive layer, in which a coloring fine particle remains, upon irradiation with an X-ray irradiation, while generating a carrier within the photosensitive layer.

9 Claims, 5 Drawing Sheets

IMAGE-FORMING APPARATUS USING X-RAY FOR CHARGING AND CLEANING A PHOTOSENSITIVE MEMBER

BACKGROUND OF THE INVENTION

1. Field of the Invention

The present invention relates to an image-forming apparatus such as facsimile machine, copier, or laser printer which, based on input information, forms a visible image on the surface of a flexible recording medium such as paper.

2. Related Background Art

As such an image-forming apparatus, there has conventionally been known an electronic copier using Carlson method such as that shown in FIG. 5. In this electronic copier, input information is copied as will be explained in the following.

Namely, first, at a corona charger portion 1, corona discharge is used to electrically charge a semiconductor layer called "photosensitive body" in a dark place. Then, at an exposure portion 2, an original to be copied (input information) is irradiated with light so as to form an electrostatic latent image, which has the same pattern as that of the original, on the photosensitive body. Subsequently, at a developing portion 3 a coloring fine particle called "toner", which is charged to a polarity opposite to that of the electrostatic latent image, is sprinkled on the photosensitive body. This toner is constituted by resin powder whose particle size is about a few μm to 50 μm. Carbon black or the like is added to the surface or the whole of the powder, and magnetic powder whose particle size is about 0.1 μm to 0.5 μm is dispersed in the resin. Then, at a transfer portion 4, the copied image on the photosensitive body formed by the toner is copied on white paper by means of electrostatic force. Subsequently, at a fixing portion 5, the toner is melted with heat so as to be impregnated between fibers of the paper and fixed onto the latter. Thereafter, at a cleaning portion 6, the photosensitive body is destaticized and the remaining toner is cleaned, whereby the photosensitive body presumes its initial state. In this manner, the photosensitive body is repeatedly used. Such a series of processing is completed within a few seconds.

SUMMARY OF THE INVENTION

The object of the present invention is to provide an image-forming apparatus which does not unfavorably influence its surrounding environment when in use and is excellent in durability of use and safety.

Namely, the present invention is an image-forming apparatus comprising an insulator having a photosensitive layer formed on a surface thereof, charge means for electrically charging the photosensitive layer surface, exposure means for exposing the charged photosensitive layer surface with light to form an electrostatic latent image corresponding to an image to be formed, developing means for attaching a coloring fine particle to the electrostatic latent image, transfer means for transferring the coloring fine particle attached to an area of the electrostatic latent image to a recording medium, fixing means for fixing the coloring fine particle transferred to the recording medium, and cleaning means for cleaning the coloring fine particle remaining on the photosensitive layer surface. The charge means is constituted by charging X-ray generation means, which electrolytically dissociates the air on the photosensitive layer surface upon irradiation with an X-ray, and electric-field application means which guides, by means of an electric field, a gaseous ion formed by this electrolytic dissociation to the photosensitive layer surface. The cleaning means is constituted by erasure X-ray generation means which ionizes the air on the photosensitive layer, in which the coloring fine particle remains, upon irradiation with an X-ray, while generating a carrier within the photosensitive layer.

In accordance with the present invention configured above, the gaseous ion generated on the photosensitive layer by the charging X-ray generation means in the charge means is guided, by an electric field generated by the electric-field application means, to the photosensitive layer surface, thereby electrically charging the latter.

Also, the gaseous ion generated on the photosensitive layer by the erasure X-ray generation means in the cleaning means neutralizes the coloring fine particle remaining on the photosensitive layer surface, while the erasure X-ray generation means generates a carrier within the photosensitive layer. This carrier extinguishes the electrostatic latent image formed in the photosensitive layer.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

In the conventional image-forming apparatus mentioned above, due to the use of corona discharge in the charger portion 1 for electrically charging the surface of the photosensitive body and cleaning portion 6 for destaticizing the surface of the photosensitive body, there have been the following problems. Namely, when corona discharge is used for electrically charging or destaticizing a photosensitive body, such matters as ozone, NOx, and dust may be generated at the time of corona discharge, thereby oxidizing electrodes, which are peripheral parts of the corona discharger, and deteriorating these peripheral parts. Also, they may cause a fire or the like due to corona discharge. Further, such generation of ozone and NOx is unfavorable for the environment of the earth.

In the following, various embodiments of the image-forming apparatus in accordance with the present invention will be explained with reference to the attached drawings. Among the drawings, the identical elements are referred to by the identical marks, without repeating their explanations.

(First Embodiment)

Figure 1:
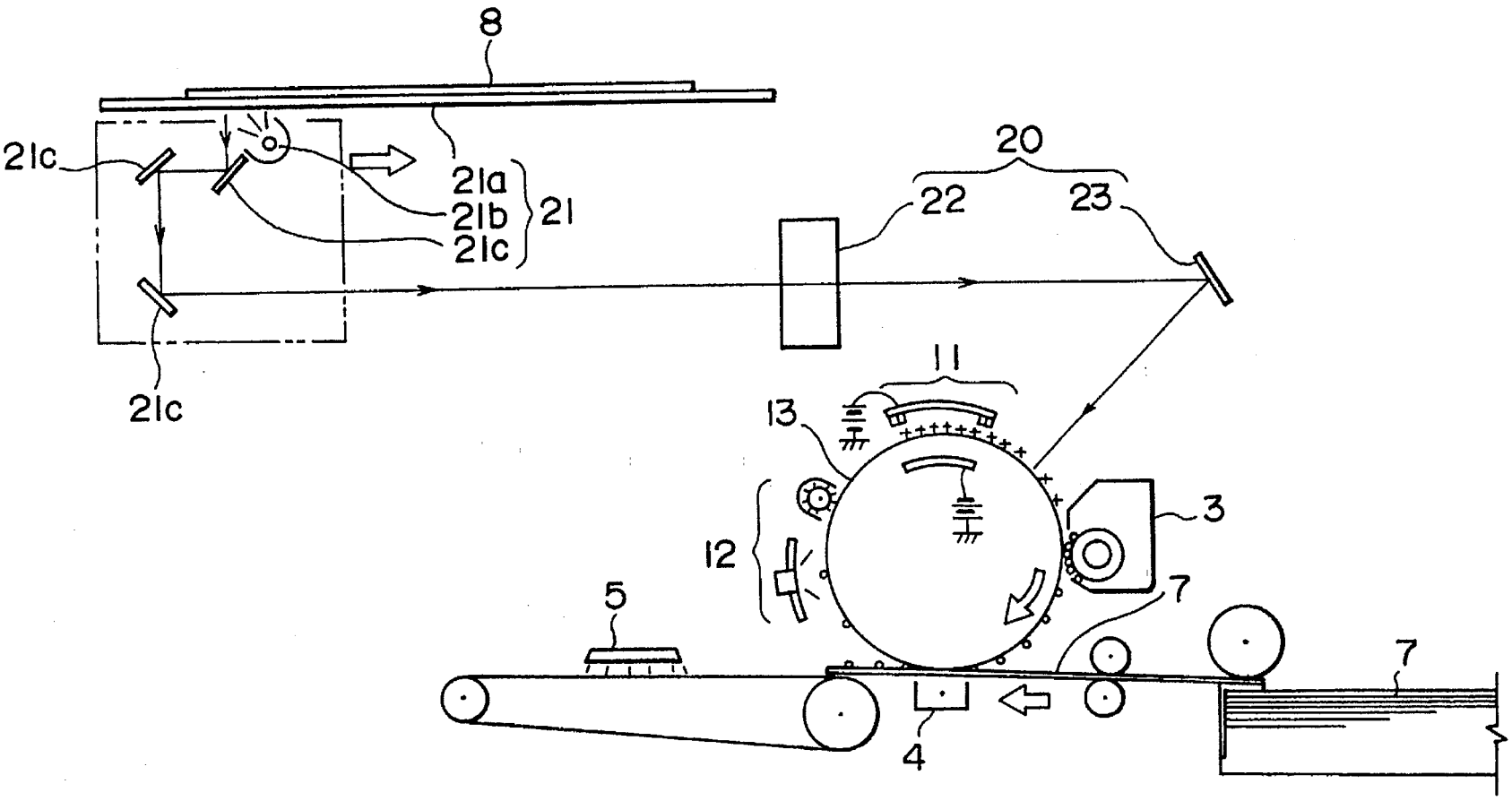
FIG. 1 is a schematic view showing the overall configuration of the image-forming apparatus in accordance with an embodiment of the present invention.
Figure 5:
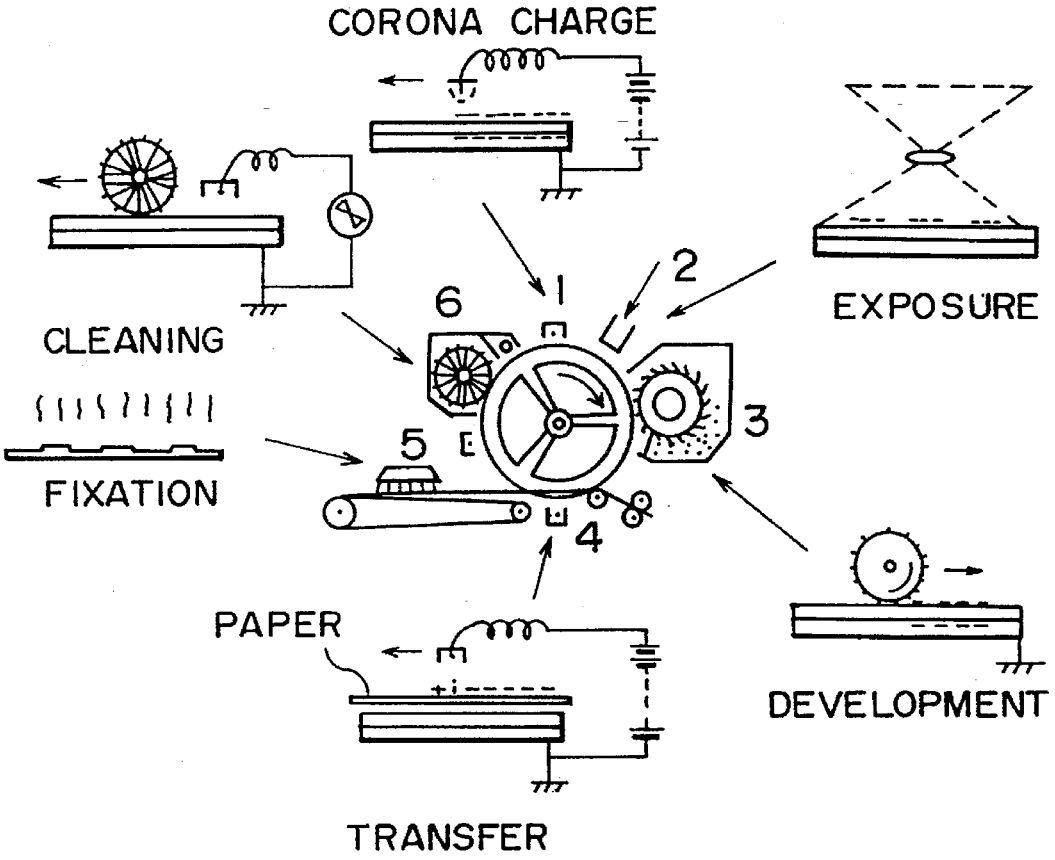
Fig. 5 (PRIOR ART)
FIG. 5 is a view showing a basic configuration of the conventional image-forming apparatus.

FIG. 1 shows the basic configuration of an image-forming apparatus. This image-forming apparatus is an apparatus in which, based on input information, forms a desirable image such as character or figure on the surface of a recording medium 7. For example, it is used as a copier equipped with a read-out mechanism 21 for reading out an image to be formed from an original 8. In this image-forming apparatus, as shown in FIG. 1, charge means 11, an exposure portion 20, a developing portion 3, a transfer portion 4, and cleaning means 12 are sequentially disposed, in the circumferential direction, in the periphery of a substrate drum 13 which is rotatable around its center axis, while a fixing portion 5 is disposed in the traveling path of the recording medium 7 which passes through between the transfer portion 4 and the outer periphery of the substrate drum 13. As the developing portion 3, transfer portion 4, and the fixing portion 5, those of the conventional apparatus shown in FIG. 5 can be used. Also, as the recording medium 7, a flexible material such as paper can be used.

Figure 2A:
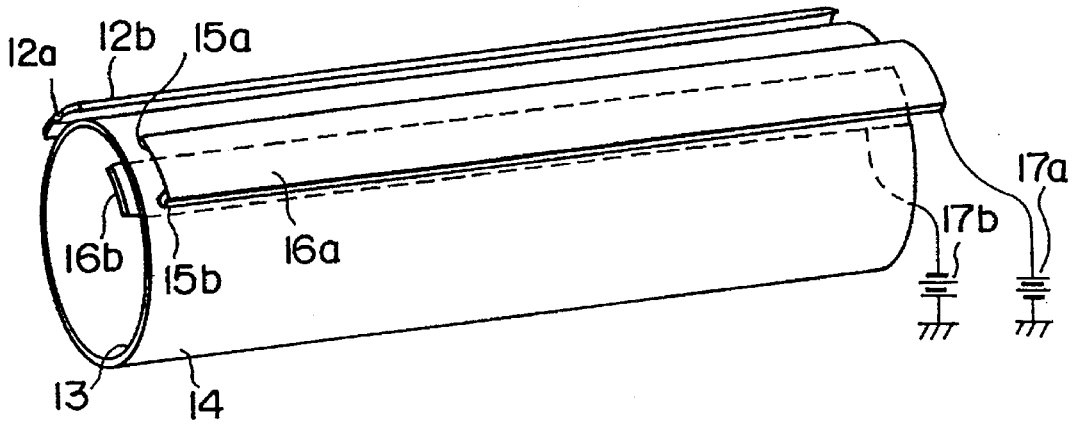
FIGS. 2A and 2B are respectively perspective and cross-sectional views showing the image-forming apparatus in accordance with this embodiment.
Figure 2B:
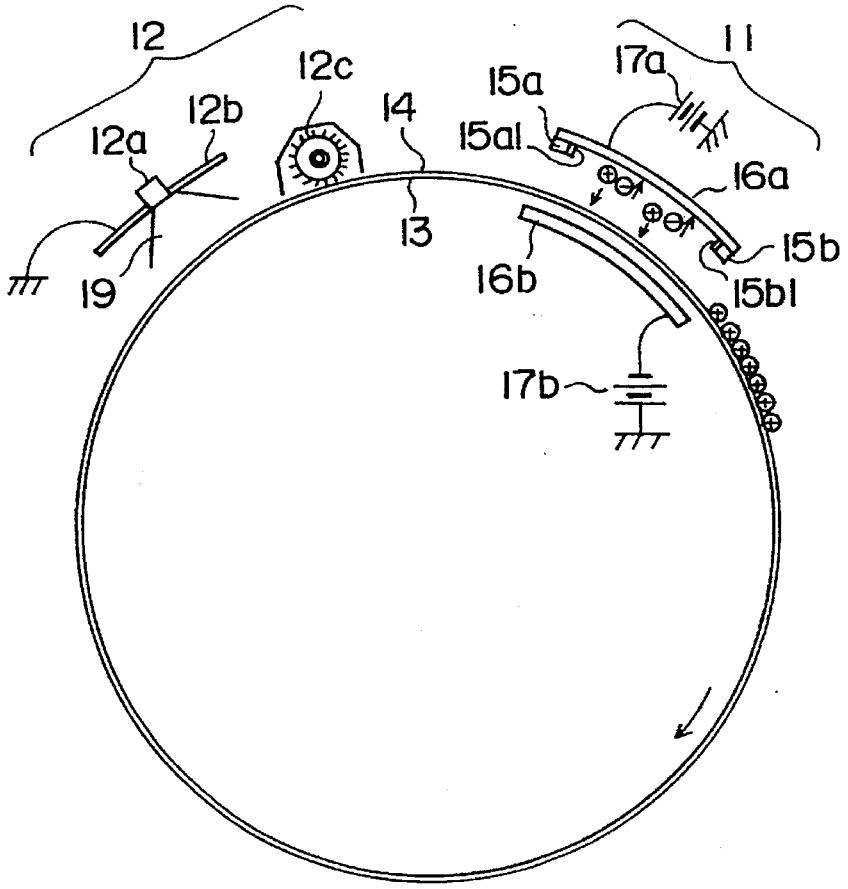

FIGS. 2A and 2B conceptually show the portions of the charge means 11 and cleaning means 12 in the image-forming apparatus, respectively as a perspective view and a cross-sectional view. In FIGS. 2A and 2B, the substrate drum 13 is made of a cylindrical insulator forming a closed loop. This substrate drum 13 is rotated around the axis of its cylinder. Due to this rotation, the substrate drum 13 moves along the closed loop. On the outer surface of the closed loop of the substrate drum 13, a photosensitive layer 14 made of a semiconductor layer is formed. The charge means 11 is used for electrically charging the surface of this photosensitive layer 14 and comprises charging X-ray tubes 15*a* and 15*b*, which are disposed outside of the above-mentioned closed loop and electrolytically dissociate the air on the photosensitive layer 14 upon irradiation with an X-ray, and electric-field application means which guides, by an electric field, a gaseous ion generated by this electrolytic dissociation to the surface of the photosensitive layer 14.

The electric-field application means comprises an external fixed electrode 16*a* and an internal fixed electrode 16*b*, each of which is made of a metal plate, as well as a first power supply 17*a* and a second power supply 17*b*. The external fixed electrode 16*a* is disposed outside of the closed loop of the surface of the photosensitive layer 14, whereas the internal fixed electrode 16*b* is disposed within the closed loop so as to face the external fixed electrode 16*a* by way of the substrate drum 13 including the photosensitive layer 14. The first power supply 17*a* applies a voltage of positive polarity 0 to $V_+$ [V] to the external fixed electrode 16*a*, whereas the second power supply 17*b* applies a voltage of negative polarity $V_-$ [V] to the internal fixed electrode 16*b*. Upon this voltage application, an electric field directed from the external fixed electrode 16*a* to the internal fixed electrode 16*b* is formed between the external fixed electrode 16*a* and the internal fixed electrode 16*b*.

The charging X-ray tubes 15*a* and 15*b* are disposed along respective end portions of the rectangular external fixed electrode 16*a*. In order to uniformly electrically charge the surface of the photosensitive layer 14, each of these charging X-ray tubes 15*a* and 15*b* is preferably constituted by a long-type X-ray tube as in the case of this embodiment rather than by a plurality of short X-ray tubes arranged in the longitudinal direction of the drum. Also, X-ray output windows $\mathbf{15}_{a1}$ and $\mathbf{15}_{b1}$ of these charging X-ray tubes 15*a* and 15*b* have a capillary form such that each of X-rays emitted from these output windows $\mathbf{15}_{a1}$ and $\mathbf{15}_{b1}$ has a directivity. Namely, while the charging X-ray tubes 15*a* and 15*b* irradiate the air between the external fixed electrode 16*a* and the photosensitive layer 14 with X-rays, these X-rays are emitted in parallel to the surface of the photosensitive layer 14 without impinging thereon.

Here, as long as the charging X-ray tubes 15*a* and 15*b* can emit X-rays between the external fixed electrode 16*a* and the substrate drum 13, they are not always have to be attached to the external fixed electrode 16*a* and not limited to those emitting X-rays in parallel to the outer surface of the substrate drum 13. The charging X-ray tube can emit X-rays in a direction from the outside of the substrate drum 13 to the center of the substrate drum 13.

On the other hand, in the cleaning means 12, an erasure X-ray tube 12*a* is disposed outside of the closed loop of the substrate drum 13. This X-ray tube 12*a* is also constituted by a long-type X-ray tube and emits an X-ray 19 to the surface of the photosensitive layer 14. This erasure X-ray tube 12*a* and the above-mentioned charging X-ray tubes 15*a* and 15*b* generate X-rays within the energy range of 1 to 20 keV. On the both sides of the erasure X-ray tube 12*a*, a metal plate 12*b* is disposed along the longitudinal direction thereof. This metal plate 12*b* is grounded. Also, a brush cleaner 12*c* is disposed at a position which is close to the erasure X-ray tube 12*a* in the direction of the rotation of the substrate drum 13.

As shown in FIG. 1, the exposure portion 20 is provided with the read-out mechanism 21 for reading out the image to be formed from the original 8. This exposure portion 20 is a portion where the surface of the photosensitive layer 14, which has been electrically charged by the charge means 11, is exposed to light so as to form an electrostatic latent image corresponding to the image to be formed. For example, it is constituted by the read-out mechanism 21, a lens system 22, and an irradiation mirror 23. The read-out mechanism 21 comprises a mounting table 21*a*, an illumination lamp 21*b*, and a plurality of reflection mirrors 21*c*, such that it can read out the image to be formed from the original 8 as an optical signal. Namely, the illumination lamp 21*b* and the reflection mirrors 21*c* are disposed below the transparent mounting table 21*a* so as to be movable along the mounting table 21*a*, whereby, after the original 8 is set on the mounting table, the images represented on the surface of the original 8 are sequentially read out as optical signals as the illumination lamp 21*b* and the reflection mirrors 21*c* are moved while the illumination lamp 21*b* illuminates the original 8 through the mounting table 21*a*. Also, by way of the predetermined lens system 22 and irradiation mirror 23, these optical signals impinge on the outer surface of the substrate drum 13 between the charge means 11 and the developing portion 3, thereby forming the electrostatic latent image thereon.

Figure 3A:
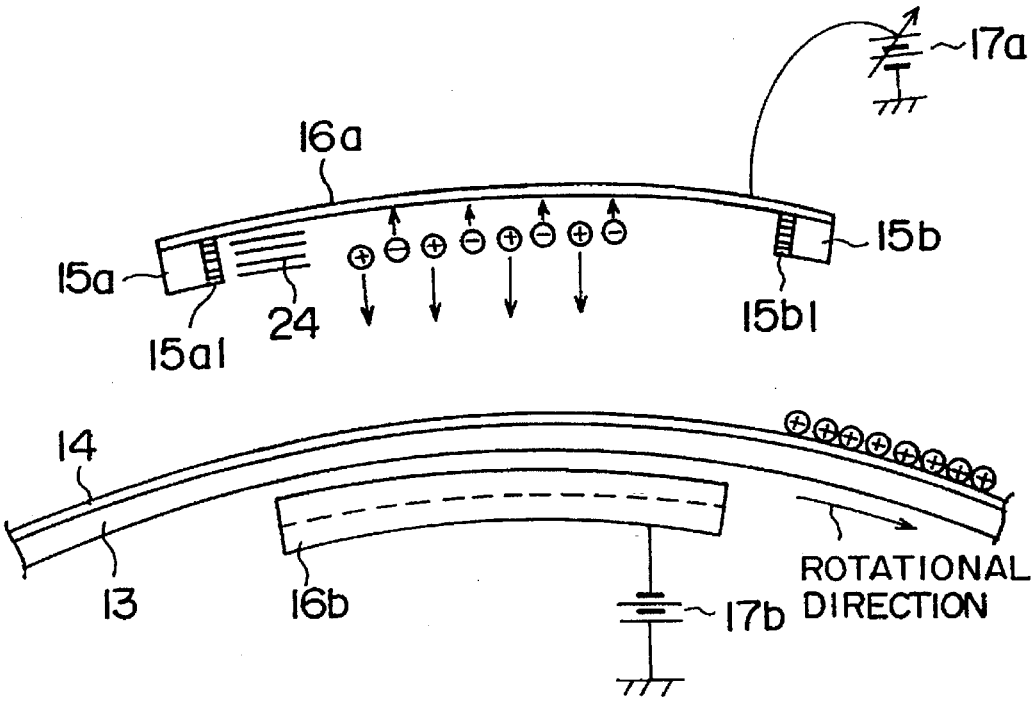
FIGS. 3A and 3B are partially enlarged cross-sectional views showing the charge means in the image-forming apparatus shown in FIG. 1.
Figure 3B:
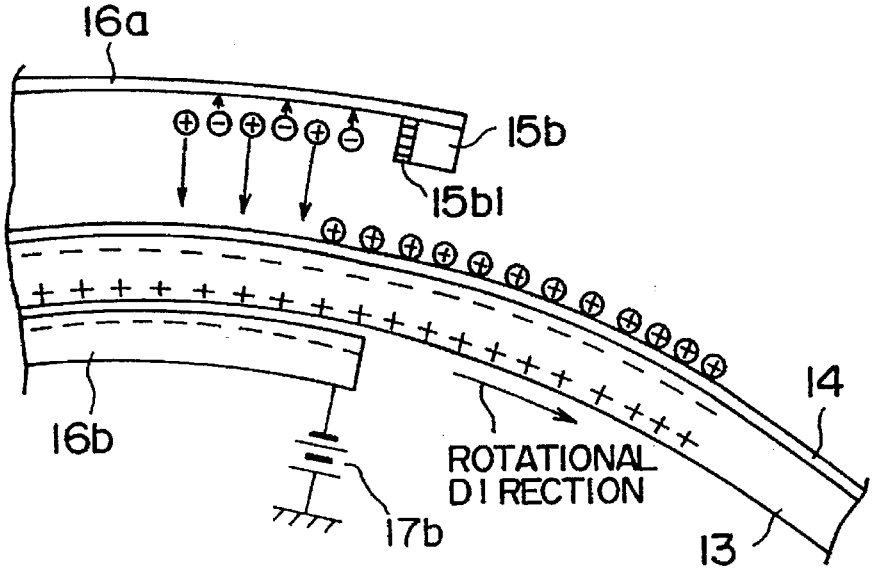

In the following, the charging mechanism in the image-forming apparatus configured above will be explained with reference to FIGS. 3A and 3B. In these drawings, the parts identical to those of FIGS. 2A and 2B are referred to by the identical marks, without repeating their explanations.

When the first power supply 17*a* and the second power supply 17*b* respectively apply a voltage of positive polarity 0 to $V_+$ [V] and a voltage of negative polarity $V_-$ [V] to the external fixed electrode 16*a* and the internal fixed electrode 16*b*, an electric field directed from the external fixed electrode 16*a* to the internal fixed electrode 16*b* is generated between the external fixed electrode 16*a* and the internal fixed electrode 16*b*. Under this condition, X-rays 24 are emitted from the X-ray tubes 15*a* and 15*b* in parallel to the surface of the photosensitive layer 14. Upon irradiation with the X-rays 24, the air between the external fixed electrode 16*a* and the photosensitive layer 14 is electrolytically dissociated, thereby generating gaseous ions electrically charged to positive and negative polarities on the surface of the photosensitive layer 14 as shown in FIG. 3A.

Also, due to the electric field formed between the external fixed electrode 16*a* and the internal fixed electrode 16*b*, the substrate drum 13 is polarized. Due to this polarization, as shown in FIG. 3B, positive charge (+) and negative charge (−) respectively appear on the internal and external peripheries of the substrate drum 13. Accordingly, among the gaseous ions generated on the surface of the photosensitive layer 14 upon irradiation with X-rays, those charged to positive polarity (+) are guided to the surface of the photosensitive layer 14 by the electric field generated between the electrodes and then drawn by the electrostatic force of negative electric charge (−) generated on the outer periphery of the substrate drum 13, thereby charging the surface of the photosensitive layer 14 to positive polarity. Since the long-type X-ray tube is used as each of the X-ray tubes 15*a* and 15*b* as mentioned above, the air on the surface of the photosensitive layer 14 is uniformly irradiated with the X-rays, thereby uniformly generating gaseous ions in the air held between the X-ray tubes 15*a* and 15*b*. Therefore, the surface of the photosensitive layer 14 is uniformly charged with the positive electric charge (+). The polarity of the electric charge on the surface of the photosensitive layer 14 is opposite to that of the voltage applied to the internal fixed electrode 16*b*.

Also, as the voltage value applied to the external fixed electrode 16*a* is controlled, the electric charge amount Q of the positive (+) electric charge on the surface of the photosensitive layer 14 can be freely controlled. This fact will be explained in the following with reference to FIGS. 4A to 4D.

Figure 4A:
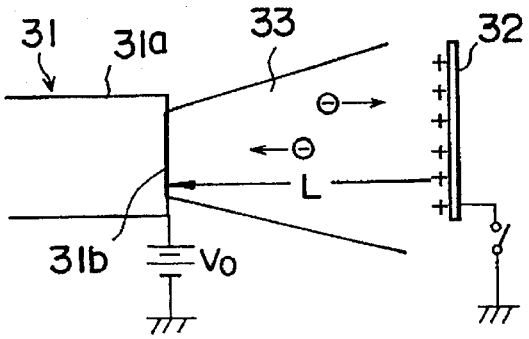
FIGS. 4A to 4D are charts showing the principle of controlling the electric charge amount by the charge means.
Figure 4B:
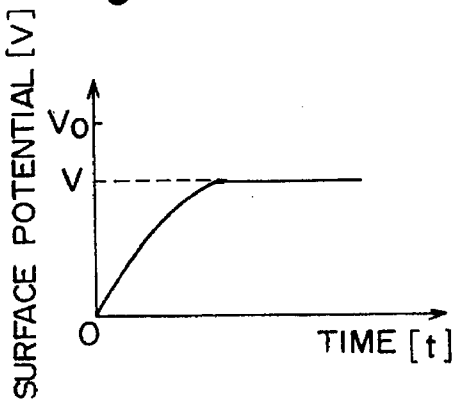

First, as shown in FIG. 4A, an X-ray 33 was emitted from an X-ray tube 31 to a metal plate 32 which was distant from the X-ray tube 31 by a distance L, whereby the surface potential of the metal plate 32 was measured. Here, a metal case 31*a* constituting the X-ray tube 31 and a Ta window 31*b* from which the X-ray was emitted were not at earth potential but a predetermined voltage $V_0$ was applied thereto. Accordingly, the target voltage of the X-ray tube 31 was exposed to the outside as it was. The results of the measurement are shown in the graph of FIG. 4B. The horizontal and vertical axes of this graph respectively indicate time [t] and surface potential [V] of the metal plate 32. As shown in this graph, the surface potential of the metal plate 32 was stabilized at a potential V [V]. While the surface potential was stabilized at the voltage V [$V<V_0$] in the case of this experiment since the area of the Ta window 31*b*, to which the voltage $V_0$ was applied, was smaller than the surface area of the metal plate 32, the surface potential of the metal plate 32 should theoretically be $V_0$ when the window 31*b* and the metal plate 32 have the same area and are placed in parallel to each other.

Figure 4C:
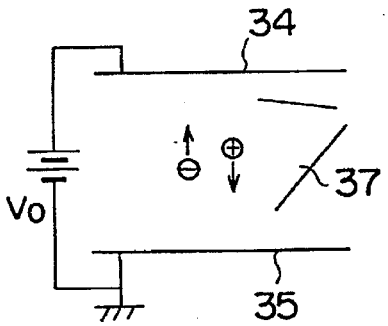
Figure 4D:
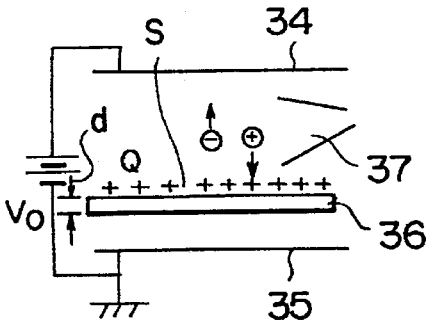

Accordingly, as shown in FIG. 4D, when an insulator 36 is inserted between plates 34 and 35, which have a potential difference $V_0$ therebetween as shown in FIG. 4C, and an x-ray 37 is emitted between the insulator 36 and one of the plates, the surface of the insulator 36 is electrically charged, whereby the surface potential of the insulator 36 theoretically becomes $V_0$. Accordingly, assuming that the thickness of the insulator 36 is d [m] and its surface area is S [$m^2$], the electric charge amount Q on the surface of the insulator 36 is expressed by the following equation:

Therefore, as the voltage $V_0$ and the thickness d of $$Q=\epsilon-\epsilon_0-(S/d)-V_0$$

the insulator 36 are adjusted, the electric charge amount Q on the surface of the insulator 36 can be controlled. Namely, when the insulator 36 is assumed to be the substrate drum 13 and the photosensitive layer 14 in this embodiment, the electric charge amount Q on the surface of the photosensitive layer 14 can be freely controlled as the voltage applied to the external fixed electrode 16*a* and the respective thickness values of the substrate drum 13 and photosensitive layer 14 are adjusted. Also, when the polarities of the voltages applied to the external fixed electrode 16*a* and internal fixed electrode 16*b* are selected in view of the polarities (+) and (−) of the toner used, the polarity of the electric charge on the surface of the photosensitive layer 14 can be arbitrarily selected.

In this manner, the surface of the photosensitive layer 14 is electrically charged by the charge means 11 of the image-forming apparatus.

Next, the erasure mechanism for the latent electric charge in the image-forming apparatus in accordance with this embodiment will be explained with reference to FIGS. 1 and 2B.

In FIG. 1, the air on the photosensitive layer 14 moved to the cleaning means 12 from the transfer portion 4 due to the rotation of the substrate drum 13 is directly irradiated with the X-ray 19 from the X-ray tube 12*a*. Upon irradiation with this X-ray 19, the air on the photosensitive layer 14 is electrolytically dissociated, thereby generating gaseous ions. Among thus generated gaseous ions, those charged to positive polarity neutralize the electric charge of the toner which has been charged to negative polarity and remains on the surface of the photosensitive layer 14. Simultaneously, the X-ray 19 emitted from the X-ray tube 12*a* generates a carrier within the photosensitive layer 14, thereby neutralizing and extinguishing the latent image formed in the photosensitive layer 14. The neutralized toner remaining on the photosensitive layer 14 is removed by the brush cleaner 12*c*, whereby the surface of the photosensitive layer 14 is cleaned.

In the following, the action of the image-forming apparatus in accordance with this embodiment will be explained.

First, in FIG. 1, the original 8 is set on the mounting table 21*a* such that its surface representing the image to be formed faces down. Under this condition, the apparatus is actuated such that, while the illumination lamp 21*b* of the exposure portion 20 is lighted, the illumination lamp 21*b* and the reflection mirrors 21*c* are moved along the original 8. Then, the light emitted from the illumination lamp 21*b* is reflected by the original 8 and guided, as an optical signal, by the reflection mirrors 21*c*, lens system 22, and irradiation mirror 23 to the substrate drum 13, thereby irradiating the photosensitive layer 14 on the surface of the substrate drum 13 as shown in FIG. 2B. On the other hand, the photosensitive layer 14 of the substrate drum 13 moves together with the rotation of the substrate drum 13, while its surface is electrically charged by the charge means 11.

When thus charged photosensitive layer 14 is moved to the exposure position of the exposure portion 20, electrostatic latent images corresponding to images of the original 8 are sequentially formed on its surface upon exposure to the light emitted from the exposure portion 20. Then, when the photosensitive layer 14 is moved to the developing portion 3, a toner, which is a coloring fine particle charged to a polarity different from that of the electrostatic latent image, is attached to the area of such an electrostatic latent image.

While a black toner is usually used therefor, it may be in other colors as well. When the photosensitive layer 14 is further moved to the transfer portion 4, the recording medium 7, on which an image is to be formed, is supplied, in synchronization with this movement, between the substrate drum 13 and the transfer portion 4, whereby the toner on the photosensitive layer 14 is transferred to the recording medium 7 due to the electrostatic force from the transfer portion 4. After this transfer, the recording medium 7 is moved to the fixing portion 5, where thetoner is fixed to the recording medium 7 upon heating at the fixing portion 5 so as to form a desirable image on the recording medium 8. On the other hand, while there remains a toner in the photosensitive layer 14 after the transfer of the toner, such a toner is securely destaticized and cleaned by the cleaning means 12 as mentioned above, whereby the photosensitive layer 14 resumes its initial state. Then, after the photosensitive layer 14 is electrically charged by the charge means 11, the steps of exposure, development, transfer, and cleaning are repeated so as to form an image.

(Second Embodiment)

While the cylindrical substrate drum 13 is used as an insulator for moving the photosensitive layer 14 in the image-forming apparatus in accordance with the first embodiment explained in the foregoing, the insulator should not be restricted thereto. For example, a sheet film belt made of an insulating material forming a closed loop may be used as the insulator. In this case, the photosensitive layer 14 is formed on the surface of the sheet film belt outside of the closed loop, while the belt is configured so as to be movable along the closed loop. Also, as in the above-mentioned embodiment, the charge means 11 and the cleaning means 12 are disposed outside of the closed loop. In such a configuration, the effects similar to those of the first embodiment can be attained as well.

(Third Embodiment)

While the photosensitive layer 14 is formed on the closed-loop substrate drum 13 or sheet film belt in the image-forming apparatus in accordance with the first or second embodiment, the material on which the photosensitive layer 14 is formed may not be limited to those of a closed loop but may be planar as well. For example, the photosensitive layer 14 may be disposed on one surface of a plate made of an insulator which is sequentially moved to positions where the charge means 11, exposure portion 20, developing portion 3, transfer portion 4, and cleaning means 12 are respectively disposed, such that an image is fixed at the fixing portion 5 to the recording medium 7 which is supplied to the transfer portion 4. Such a configuration also yield effects similar to those of the first embodiment. Here, the above-mentioned plate may also have an arc-like form.

(Fourth Embodiment)

While the cases where the image-forming apparatus is used as a copier are explained in the first to third embodiments, without being limited to such a use, this image-forming apparatus can be applied to other instruments as long as they form images. For example, when the input means for optical signals in the above-mentioned exposure portion 20 is changed, the apparatus can be used as such instruments as facsimile machine and laser printer, while yielding effects similar to those of the first embodiment.

In the present invention, as explained in the foregoing, the gaseous ion generated on the photosensitive layer by the charging X-ray generation means in non-contact charge means is guided, by an electric field generated by the electric-field application means, to the photosensitive layer surface, thereby electrically charging the latter. Also, the gaseous ion generated on the photosensitive layer by the erasure X-ray generation means in the cleaning means neutralizes the coloring fine particle remaining on the photosensitive layer surface. Also, the carrier generated within the photosensitive layer extinguishes, in a non-contact manner, the electrostatic latent image formed in the photosensitive layer. Therefore, the charging and destaticizing of the photosensitive layer can be effected without using the conventional corona discharge and, accordingly, such matters as ozone, NOx, and dust are not generated by the image-forming apparatus in accordance with the present invention. Thus, it can overcome the conventional problems that electrodes, which are peripheral parts of the charge means and static eliminator means, may be oxidized to deteriorate the peripheral parts. Also, for example, there is no possibility of a fire being generated due to corona discharge. Further, an image-forming apparatus which is preferable for the environment of the earth can be realized.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No.11015/1995 filed on Jan. 26, 1995 is hereby incorporated by reference.

What is claimed is:

1. An image-forming apparatus for forming an image on a recording medium, comprising:

an insulator having a photosensitive layer formed on a surface thereof;

charge means for electrically charging a surface of said photosensitive layer, said charge means having charging X-ray generation means, which electrolytically dissociates air on the surface of said photosensitive layer by irradiation of an X-ray, and electric-field application means which guides, by means of an electric field, a gaseous ion formed by the electrolytic dissociation to the surface of said photosensitive layer;

exposure means for exposing the charged surface of said photosensitive layer with light to form an electrostatic latent image corresponding to said image to be formed;

developing means for attaching a coloring fine particle to an area of said electrostatic latent image;

transfer means for transferring said coloring fine particle attached to the area of said electrostatic latent image to said recording medium;

fixing means for fixing said coloring fine particle transferred to said recording medium; and cleaning means for cleaning said coloring fine particle remaining on the surface of said photosensitive layer, said cleaning means having erasure X-ray generation means which ionizes air on the surface of said photosensitive layer, in which said coloring fine particle remains, by irradiation of an X-ray, and generates a carrier within said photosensitive layer.

2. An image-forming apparatus according to claim 1, wherein said electric-field application means comprises a first electrode formed on a side of said insulator on which said photosensitive layer is formed, a second electrode disposed so as to face said first electrode by way of said insulator, and a power supply for applying a voltage between said first and second electrodes, and wherein said charging X-ray generation means comprises an X-ray tube which emits an X-ray to air between said first electrode and said photosensitive layer.

3. An image-forming apparatus according to claim 2, wherein said X-ray tube emits the X-ray in a direction substantially parallel to the surface of said photosensitive layer.

4. An image-forming apparatus according to claim 1, wherein said insulator comprises a cylindrical drum.

5. An image-forming apparatus according to claim 1, wherein said insulator comprises a belt in a closed loop.

6. An image-forming apparatus according to claim 1, wherein said insulator is planar and sequentially moved to positions where said charge means, said exposure means, said developing means, said transfer means, and said cleaning means are respectively disposed.

7. An image forming apparatus according to claim 1, wherein said image-forming apparatus is used as a copier.

8. An image-forming apparatus according to claim 1, wherein said image-forming apparatus is used as a facsimile machine.

9. An image-forming apparatus according to claim 1, wherein said image-forming apparatus is used as a laser printer.

* * * * *